United States Patent [19]

D'Amato

[11] 4,112,562

[45] Sep. 12, 1978

[54] PROCESS OF FABRICATING A CATHODE RAY TUBE

[75] Inventor: Ralph James D'Amato, Lancaster, Pa.

[73] Assignee: RCA Corporation, New York, N.Y.

[21] Appl. No.: 823,336

[22] Filed: Aug. 10, 1977

[51] Int. Cl.[2] ..... H01J 9/02; H01J 9/227

[52] U.S. Cl. ..... 29/25.14; 29/25.15; 29/25.18

[58] Field of Search ..... 29/25.14, 25.15, 25.16, 29/25.17, 25.18; 354/1

[56] References Cited

U.S. PATENT DOCUMENTS

| | | | |
|---|---|---|---|
| 3,688,360 | 9/1972 | Miyata | 29/25.18 |
| 3,889,329 | 6/1975 | Fazlin | 29/25.14 |
| 3,973,964 | 8/1976 | Lange | 29/25.18 X |
| 3,983,613 | 10/1976 | Palac | 29/25.19 |
| 4,020,493 | 4/1977 | Palac | 354/1 |

*Primary Examiner*—Richard B. Lazarus

*Attorney, Agent, or Firm*—E. M. Whitacre; G. H. Bruestle; D. H. Irlbeck

[57] ABSTRACT

The process includes exposing a photosensitive coating on a surface of the faceplate panel of a tube with actinic radiation passed through a patterned screen master, developing the panel coating and then mounting a formed imperforate member to the panel. A photosensitive coating on the imperforate member is exposed with actinic radiation passed through a patterned color selection electrode master while the imperforate member is mounted to the panel. The imperforate member coating is then developed and the imperforate member is etched to form an apertured color selection electrode.

9 Claims, 3 Drawing Figures

PROCESS OF FABRICATING A CATHODE RAY TUBE

BACKGROUND OF THE INVENTION

This invention relates to a process of fabricating cathode-ray tubes and particularly to a process for forming cathodoluminescent screens and apertured color selection electrodes in such tubes.

Cathode-ray tubes for use in color television usually include a cathodoluminescent screen of red, green and blue emitting phosphor lines or dots, electron gun means for exciting the screen, and an apertured mask interposed between the gun means and the screen. The apertured mask is a thin metal sheet precisely disposed adjacent to the screen so that the mask apertures are systematically related to the phosphor lines or dots.

Presently, cathode-ray tubes utilizing color selection techniques that require an apertured mask are generally manufactured employing the practice of pairing. This means that a finish-fabricated apertured mask is paired with a faceplate panel and is used as a patterned master during formation of a screen on the faceplate. After screen formation, the mask is incorporated into the tube to serve its color selection function.

The method of pairing, although it generally produces a commercially acceptable tube, has several disadvantages. Formation of a screen requires the insertion and removal of the mask several times. During each such insertion and removal, the chances of denting or otherwise damaging the mask are relatively high. Additionally, there is also a possibility that the mask will not reset properly in the panel. Furthermore, in a negative tolerance matrix shadow mask type tube or in a focus mask tube wherein the size of the electron-excited screen areas are smaller than their associated apertures, other problems may be encountered. For example, in one method for forming such tubes, a mask used as a patterned master to form a screen is reetched to enlarge its apertures. During a second etch there is the possibility of either damaging the mask or over etching it. Such occurrences result in a faceplate that must be totally rescreened utilizing a different mask.

Therefore, there is a need for tube construction methods that minimize the amount of manual handling and, if possible, permit the use of replaceable color selection electrodes without the need for rescreening a tube.

SUMMARY OF THE INVENTION

A process of fabricating a cathode-ray tube includes exposing a photosensitive coating on a surface of a faceplate panel of the cathode-ray tube with actinic radiation passed through at least one patterned screen master, developing the panel coating, and then mounting a formed imperforate member to the panel. A photosensitive coating on the imperforate member is exposed with actinic radiation passed through a patterned color selection electrode master while the imperforate member is mounted to the panel. The coating is then developed and the imperforate member is etched to form an apertured color selection electrode.

DESCRIPTION OF THE PREFERRED EMBODIMENT

Figure 1:
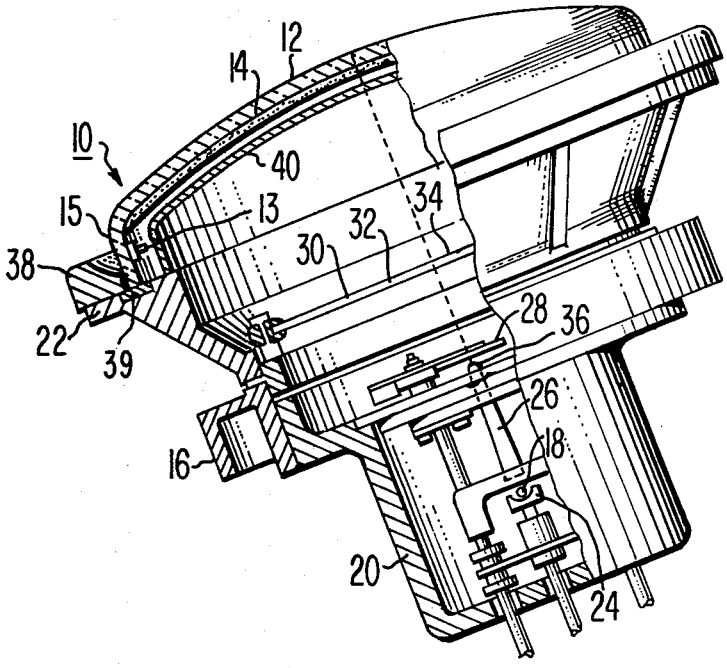
FIG. 1 is a partially sectioned elevation view of a lighthouse for exposing a cathode-ray tube screen.

Referring to FIG. 1, there is shown a faceplate assembly 10 comprising a faceplate panel 12 and a photo-sensitive film or coating 14 on the inner surface of the panel 12. A plurality of mounting studs 13 extend inwardly from a sidewall of the panel 12 for use in mounting a color selection electrode assembly to the panel 12. The faceplate assembly 10 is shown positioned on an exposure apparatus known in the art as a "lighthouse" 16. The lighthouse 16 is designed to expose the coating 14 by projecting actinic radiation (which hereinafter will be referred to simply as light even though it doesn't necessarily include the visible spectrum) from a small area point or line light source 18.

The lighthouse 16 comprises a housing 20 which includes a panel support 22, the light source 18, a reflector 24, a collimator 26, an eclipser 28 and a lens assembly 30. The collimator 26 can be omitted if a bare lamp is used as a line source to expose a line screen. The panel support 22 is adapted to support the faceplate panel 12 accurately aligned over the light source 18 as shown in FIG. 1. The lens assembly 30 includes a correction lens 32 having a light correcting filter 34 on the upper surface thereof. The collimator 26 comprises a light pipe in the form of a tapered quartz rod with the narrow end 36 constituting a small area point or line source of light for the lighthouse 16. The eclipser 28 is operated to interrupt the light projected to the coating 14. The collimator 26, eclipser 28 and lens assembly 30 are located between the light source 18 and the faceplate panel 12. The reflector 24 is positioned below the light source 18. The exact position of the faceplate panel 12 with respect to X and Y coordinates (X and Y being orthogonal axes perpendicular to the central longitudinal axes of the lighthouse) is determined by three locating stops 38 (one shown) which are attached to the panel support 22 and by associated pads 39 which contact a seal edge of the panel and locate the panel along a Z direction (along the central longitudinal axis of the lighthouse). In the embodiment shown, the panel 12 is held against the stops 38 and pads 39 by the force of gravity since the entire lighthouse 16 is tilted with respect to the vertical. Alternately, the faceplate panel 12 could be held against the stops by use of springs located opposite the stops.

Also positioned on the panel support 22 within the faceplate panel 12 is a patterned screen master 40 which in the embodiment shown is a photographic master. This screen master 40 serves in place of an apertured color selection electrode which the prior art has used as a master in screening a color picture tube. The screen master 40 can be an apertured metal sheet similar to a color selection electrode or it can be a glass sheet, either contoured or flat, having a pattern of clear and opaque areas thereon. In a matrix version of a tube that is processed using a negative-acting photosensitive material, the clear areas can correspond to the matrix openings on the screen where light emitting phosphors are to be located. Of course, if a positive acting type of photosensitive coating is used on the faceplate panel, the clear and opaque areas of the master can be reversed. The spacing between the screen master 40 and the faceplate panel 12 can be kept rather close, for example, less than 1 centimeter thereby minimizing many problems encountered in obtaining desired opening size such as caused by fringing or varied penumbra size. This is unlike the spacing used when screening with a shadow mask wherein the mask to panel distance is several centimeters greater.

The light source 18, lens assembly 30, screen master 40 and locating stops 38 and pads 39 are fixed relative to each other. A particular faceplate panel assembly, when seated against the stops 38 and pads 39 will then have a specific relationship to the light source 18 and the patterned screen master 40. Therefore, a screen formed on the inner surface of the faceplate will be accurately located with respect to the stops 38 and pads 39.

Once the photosensitive coating 14 on the faceplate panel 12 has been exposed through the master 40, the panel 12 is removed from the lighthouse 16 and the coating 14 is developed utilizing an appropriate developer for the particular coating material. A preferable method for applying a light absorbing matrix to a faceplate panel is described in U.S. Pat. No. 3,558,310 issued to E. E. Mayaud on Jan. 26, 1971, which patent is hereby incorporated by reference for the purpose of including such description. In this prior art process of forming a light absorbing selection electrode which is eventually incorporated into a completed tube to perform such function but rather utilizes a separate patterned screen master such as a photographic master, the pattern on such separate master can include all three matrix openings for the phosphor element arrays and thus the screen requires only a single exposure to form a matrix. When such a master is employed, the location and size of the matrix openings relative to each other is more accurate than when three separate exposures are used.

The application of the phosphor elements to the screen can be accomplished in several ways. In one method, the same master can be used as was used to form the matrix. In such a method, different portions of the master pattern corresponding to locations of two color arrays are sequentially blocked by known photographic techniques in three exposure steps so that the three color arrays are effectively individually exposed. In another method, three additional screen masters, one corresponding to each color phosphor array, are used in three separate exposures to form the three phosphor arrays. In yet another method, one master can be displaced to different positions relative to the light source corresponding to the individual color masters. A process for depositing phosphor arrays is described in an article entitled, "Color-Television Screening by the Slurry Process" by T. A. Saulnier, Jr., in *Electromechanical Technology*, 4, 27–31 (1966) and in U.S. Pat. No. 3,406,068 issued to H. B. Law on Oct. 15, 1968 which patent is hereby incorporated by reference for the purpose of including a description of phosphor element formation.

Figure 2:
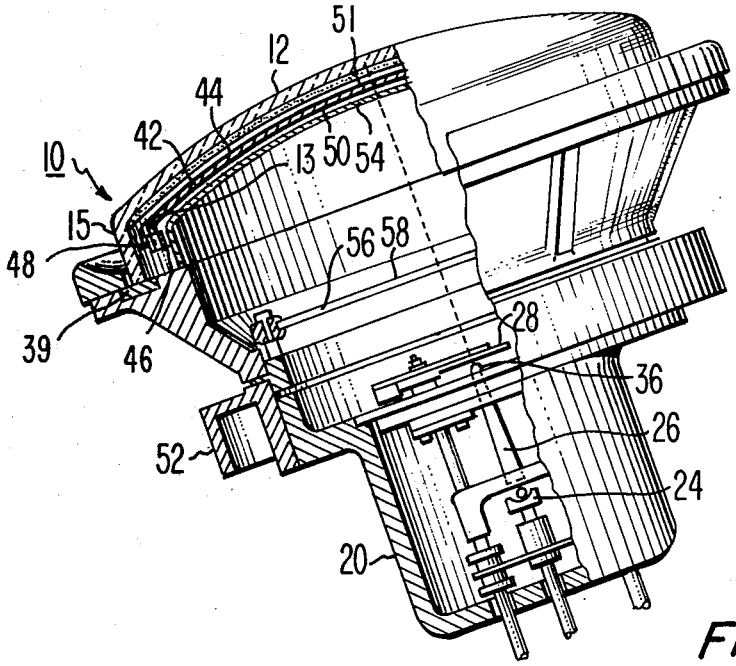
FIG. 2 is a partially sectioned elevation view of another lighthouse for exposing a color selection electrode of a cathode-ray tube.

After formation of the screen on the faceplate panel 12 has been completed, the panel 12 is removed from the lighthouse 16 and is filmed and aluminized. An assembly 42 is then mounted within the panel 12. The assembly 42 comprises a formed imperforate member 44 attached to a peripheral reinforcing frame 46. In conventional tubes, the member 44 is a somewhat spherically curved metal sheet. The side of the member 44 facing away from the screen is coated with a photosensitive material 50 while the side facing the screen is covered with a protective coating 51. The protective coating prevents a reduction in the thickness of the member 44 once apertures break through during a subsequent etching process. A plurality of springs 48 extend from the frame 46 to engage the studs 13 on the panel sidewall 15. The faceplate panel 12 next is mounted on a second lighthouse 52, shown in FIG. 2, having the same component parts as lighthouse 16 except that a patterned color selection electrode master 54 having a pattern thereon corresponding to the desired electrode apertures and a correction lens 56 having a different intensity correction filter 58 thereon, are used. Only one lighthouse is needed if the patterned masters and lenses are switched between exposures.

In either case, the photosensitive material 50 on the imperforate member 44 is exposed through the master 54. Thereafter, the assembly 42 may be removed from the panel 12 for subsequent developing of the photosensitive material 50 and etching of apertures in the member 44 to form a color selection electrode.

Optionally, a suitable protective material may be coated on the screen immediately after it is aluminized before the assembly 42 is inserted into the panel 12. The assembly 42 then may be permanently mounted in the panel 12 and the member 44 exposed as previously described. The development of the photosensitive material on member 44, as well as the etching step, then may be performed while the assembly 42 remains mounted in the faceplate panel 12.

Figure 3:
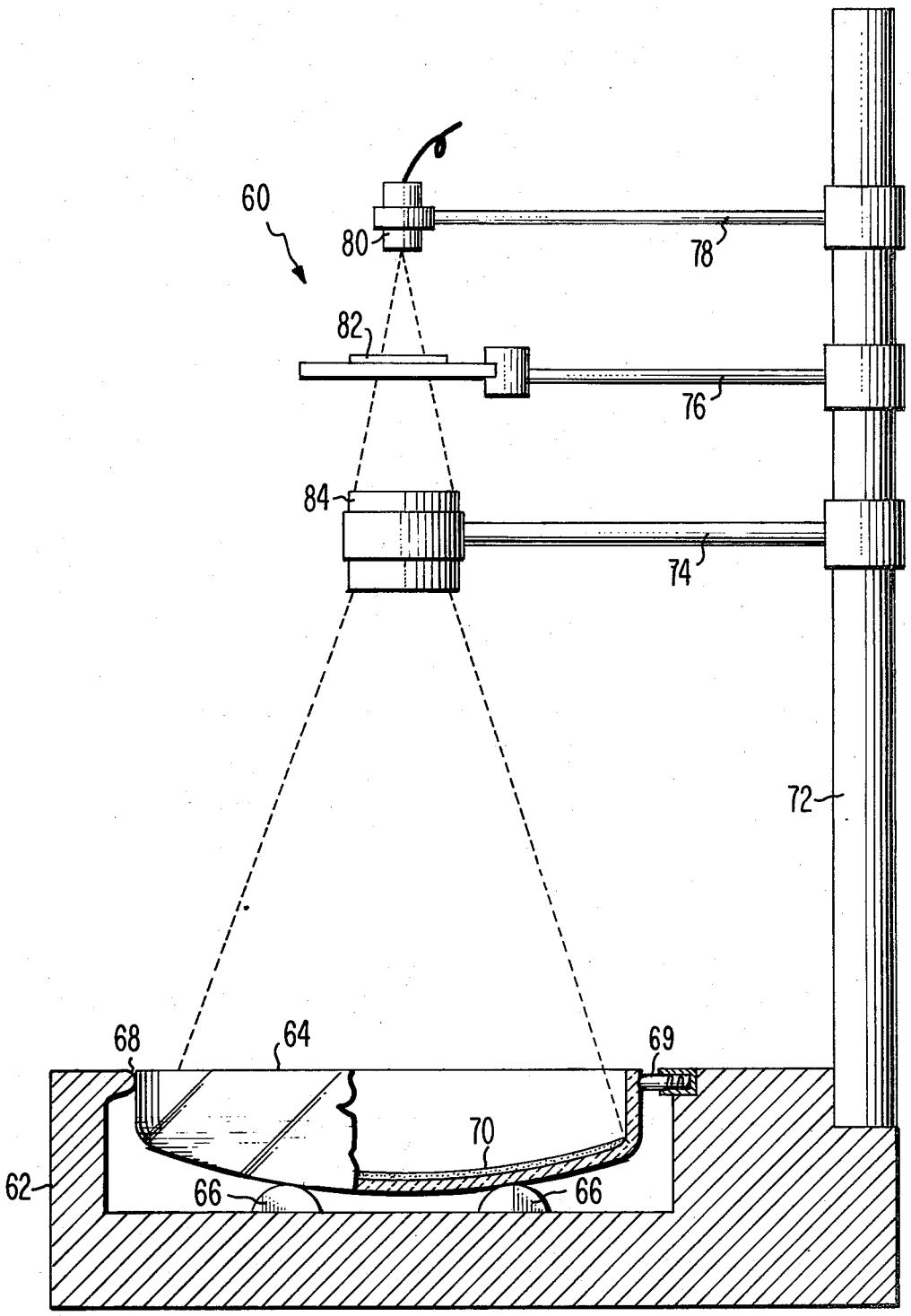
FIG. 3 is a partially sectioned elevation view of a projection device for exposing either a cathode-ray tube screen or a color selection electrode of a cathode-ray tube.

An alternative photoexposure apparatus 60 shown in FIG. 3, functions similarly to a photoenlarger. The apparatus 60 comprises a base 62 on which a tube faceplate panel 64 is mounted on spherically shaped reference bottom locators 66 and between spherically shaped reference side locators 68 (one shown). The panel 64 is held against the side locators 68 by one or more spring loaded elements 69 positioned opposite from the locators 68. The inside surface of the faceplate panel 64 is coated with a photosensitive material 70 which when exposed will form part of a viewing screen of a tube. A column 72 extends vertically from the base 62 and has three arms 74, 76 and 78 attached to it. The arms 74, 76 and 78 extend approximately to a central vertical axis passing through the tube faceplate 64. A light source 80 is affixed to the end of the uppermost arm 78 and is positioned to direct light rays downwardly to the tube faceplate 64. Directly below the light source 80, attached to the middle arm 76, is a patterned screen master 82 containing a negative pattern of elements of a viewing screen. Below the master 82 at a position near or at the predicted deflection center of a completed tube, is a suitable optical enlargement lens 84 attached to the bottom arm 74. Light rays, therefore, pass from the light source 80 through the patterned master 82 and the enlargement lens 84 to the coated faceplate panel 64 where they expose the photosensitive material 70. Preferably, a matrix portion of the screen is exposed in a single step using a single patterned master and the phosphor elements are exposed in three separate exposures using three different patterned masters, or alternatively, one master may be shifted or a cover over the master shifted to obtain similar results.

After the screen has been completed, a formed, imperforate member can be inserted in the faceplate panel 64, and an aperture pattern can be exposed on a layer of suitable photosensitive material on the member and then developed. Thereafter the member may be etched to open the apertures thus forming the color selection electrode.

In all of the steps in forming a screen and a color selection electrode with the foregoing techniques, the reference points for each step are identical. Because of this, if for any reason, the color selection electrode should become damaged during subsequent handling, another electrode could be fabricated utilizing the same technique as used in forming the first electrode. Since each faceplate and associated electrode mounting studs are somewhat unique, that is varying slightly in dimensions or locations, the foregoing described methods provide means for forming replaceable color selection electrodes of both shadow mask and focus mask types although such electrodes may not necessarily be interchangeable between different faceplates.

I claim:

1. In a process of fabricating a cathode-ray tube having a faceplate panel and an apertured color selection electrode mounted to said panel, the improvement comprising, exposing a photosensitive coating on a surface of said panel with actinic radiation passed through a patterned screen master, developing the exposed photosensitive coating on said panel, then mounting a formed imperforate member to said panel, said imperforate member having a photosensitive coating thereon, subsequently exposing the photosensitive coating on said imperforate member with actinic radiation passed through a patterned color selection electrode master while said imperforate member is mounted to said panel, developing said exposed photosensitive coating on said imperforate member, and etching said imperforate member to form an apertured color selection electrode.

2. The process as defined in claim 1 including contouring said patterned screen master to closely parallel the contour of said panel and contouring said patterned color selection electrode master to closely parallel the contour of said imperforate member.

3. The process as defined in claim 2 wherein said patterned masters are within 2 centimeters of the panel and the imperforate member, respectively.

4. In a process of fabricating a cathode-ray tube having a faceplate panel and an apertured color selection electrode mounted to said panel, the improvement comprising, positioning said panel on an exposure apparatus against reference locators on said exposure apparatus, exposing a photosensitive coating on a surface of said panel with actinic radiation through a patterned screen master accurately located with respect to said reference locators, developing the exposed photosensitive coating on said panel, the mounting a formed imperforate member to said panel, said imperforate member having a photosensitive coating thereon, subsequently exposing the photosensitive coating on said imperforate member with actinic radiation through a patterned color selection electrode master also accurately located with respect to said reference locators while said imperforate member is mounted to said panel, developing said exposed photosensitive coating on said imperforate member, and etching said imperforate member to form an apertured color selection electrode.

5. The process as defined in claim 4 wherein said reference locators are defined by a plurality of stops and pads on said exposure apparatus.

6. The process as defined in claim 4 including repeating said panel positioning, panel exposing and panel developing steps a plurality of times with different patterned screen masters.

7. The process as defined in claim 4 wherein once mounted said formed imperforate member is not removed during subsequent steps of fabricating said cathode-ray tube.

8. The process as defined in claim 7 including covering a formed screen of said tube with a material unaffected by an etchant used for etching said imperforate member.

9. The process as defined in claim 4 wherein said exposure apparatus is a photoenlarger and the projected images of the patterns of said masters are substantially enlarged when projected onto said panel and imperforate member, respectively.

* * * * *

UNITED STATES PATENT OFFICE
CERTIFICATE OF CORRECTION

PATENT NO. : 4,112,562

DATED : September 12, 1978

INVENTOR(S) : Ralph James D'Amato

It is certified that error appears in the above-identified patent and that said Letters Patent are hereby corrected as shown below:

Column 3, line 25: after"light absorbing" insert -- matrix, three separate exposure steps are required using a color seletion electrode as a patterned screen master. However, since the present invention does not use the color --.

Claim 4, column 6, line 12: change "the" to --then--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*